US007382243B1

(12) United States Patent
Shepher

(10) Patent No.: US 7,382,243 B1
(45) Date of Patent: Jun. 3, 2008

(54) PERSONAL EMERGENCY RESPONSE SYSTEM WITH INTERCONNECTED SLAVE UNITS

(76) Inventor: Isaac Shepher, 2211 Queensboro La., Los Angeles, CA (US) 90077

( * ) Notice: Subject to any disclaimer, the term of this patent is extended or adjusted under 35 U.S.C. 154(b) by 217 days.

(21) Appl. No.: 11/312,029

(22) Filed: Dec. 20, 2005

Related U.S. Application Data

(60) Provisional application No. 60/643,882, filed on Jan. 14, 2005.

(51) Int. Cl.
*G08B 26/00* (2006.01)

(52) U.S. Cl. ..... 340/505; 340/572.1; 340/572.4; 340/572.8; 235/384; 235/385; 382/181; 382/232; 382/257

(58) Field of Classification Search ..... 340/506, 340/502, 504, 539.11, 539.13, 539.16, 539, 340/550, 572.1, 572.4, 572.8; 455/428, 440, 455/429; 235/384, 385; 382/181, 232, 257
See application file for complete search history.

(56) References Cited

U.S. PATENT DOCUMENTS 3,914,692 A * 10/1975 Seaborn, Jr. ..... 455/521
4,494,119 A * 1/1985 Wimbush ..... 342/457
4,998,095 A * 3/1991 Shields ..... 340/574
5,578,989 A * 11/1996 Pedtke ..... 340/539.11

* cited by examiner

*Primary Examiner*—Tai Nguyen
(74) *Attorney, Agent, or Firm*—Panitch Schwarze Belisario & Nadel LLP

(57) ABSTRACT

A monitoring system is disclosed. The monitoring system comprises a base station and a plurality of interconnected slave units, where each one of the slave units is adapted to receiving an alarm from an alarm unit and transmitting an alert corresponding to the alarm to the base station.

13 Claims, 1 Drawing Sheet

PERSONAL EMERGENCY RESPONSE SYSTEM WITH INTERCONNECTED SLAVE UNITS

CROSS REFERENCE TO RELATED APPLICATIONS

This Application claims the benefit of Provisional Patent Application No. 60/643,882, Filed Jan. 14, 2005, the contents of which are incorporated herein in their entirety.

BACKGROUND OF THE INVENTION

1. Field of the Invention

This invention relates to personal emergency communications systems and more particularly to personal emergency communications systems which incorporate distributed input/output devices.

2. Description of the Prior Art

Typical personal emergency communications systems (PERS) employ a portable alarm unit worn by a subscriber. The alarm unit, when actuated by the subscriber, transmits an alarm signal to a fixed base station located within the subscriber's residence. When the base station receives the alarm signal, the home base system transmits an alert signal via a telephonic communication link to a central monitoring system. The operator at the central monitoring system attempts to verify the alert via two-way voice communications with the subscriber via the central monitoring system and the home base station, which has a hardwire speaker phone capability. Depending upon information or lack thereof received by the operator from the subscriber, directions may then be issued by the operator to dispatch aid to the residence from which the alert signal was received. PERS of this type have proven to be a reasonably effective tool for responding to the needs of elderly and/or infirm persons confined to their residences.

Accidents in homes may be classified into emergency accidents and non-emergency accidents. Some individuals living alone may require assistance, because of dizziness or illness, to simply rise up from a collapsed state in order to reach a telephone to obtain assistance. Such incidents while requiring assistance, may not be of an emergency nature requiring "emergency" response from EMS personnel. Alternatively, there are serious events which are true emergencies.

Each year many false alarms are generated by PERS for non-emergency types of events. On the other hand, persons involved in serious accidents having PERS in their residences have been found to have waited helplessly for hours, if not days before discovery. Persons who have encountered such serious accidents in many cases simply were unable to communicate their needs because the alarm reception capability or the speaker phone capability of the PERS was not within range of the subscriber. Both false alarms could be reduced and serious accidents could be more properly responded to if plural equivalents of the base station could be located in the residence.

Thus, it is desirable to enhance the performance of known personal emergency response systems to: (1) have the capability of reliably receiving alarms from all areas within a living space, including out-buildings and external areas and (2) have the capability of providing voice communication with the subscriber following an alarm, regardless of the location of the subscriber within the living space.

SUMMARY OF THE INVENTION

Briefly stated, the present invention is a monitoring system comprising: a base station; and a plurality of interconnected slave units, wherein each one of the slave units is adapted to: (a) receiving an alarm from an alarm unit; and (b) transmitting an alert corresponding to the alarm to the base station.

The present invention further provides a method for providing voice communication between a subscriber and a central monitoring station where the method comprises the steps of: receiving an alarm from the subscriber in at least one slave unit and transmitting from the at least one alarmed slave unit to a base station, an alert corresponding to the alarm, and thereafter, providing a full duplex voice channel between the slave unit and the central monitoring station.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
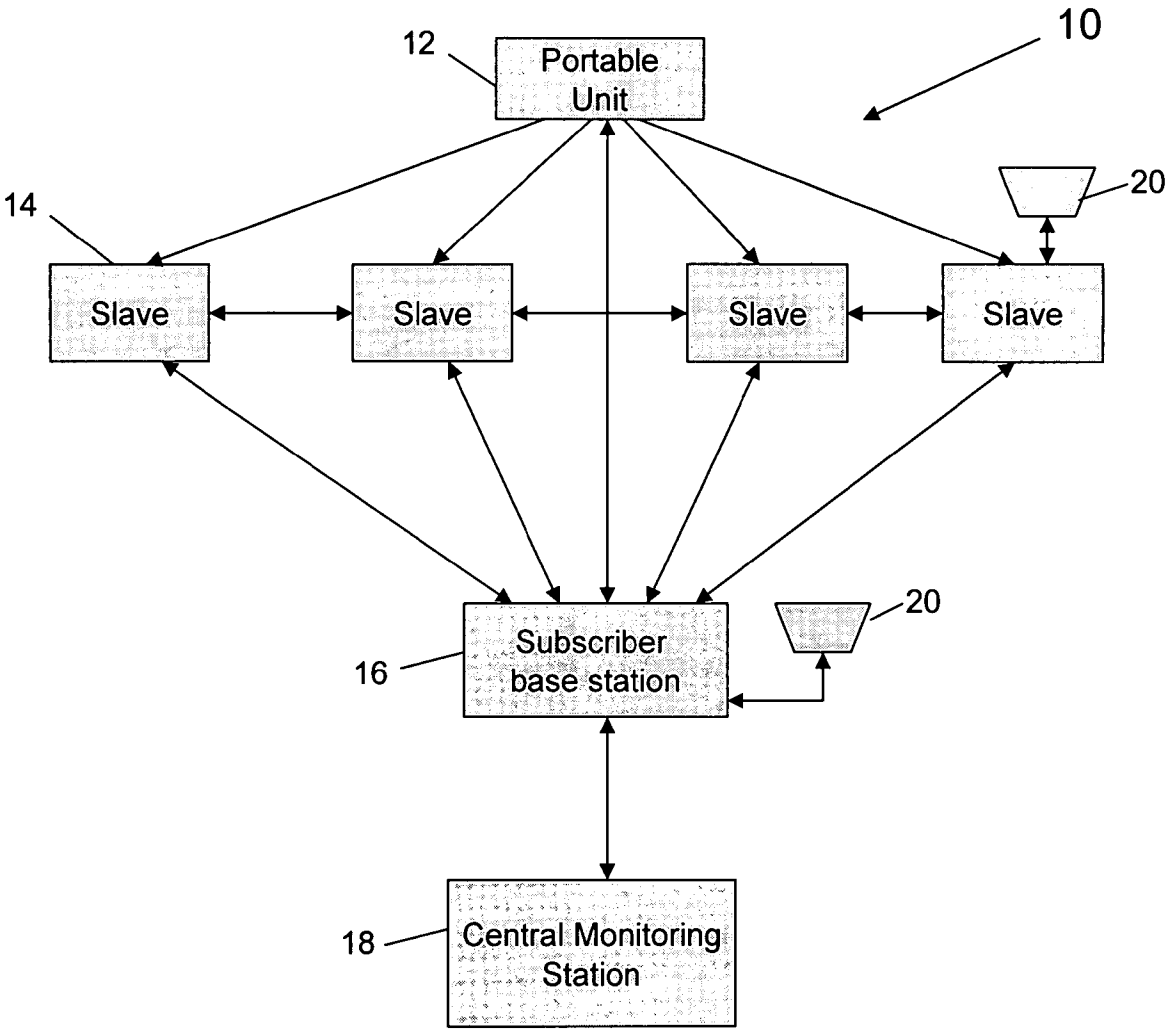
FIG. 1 is a block diagram of a personal emergency response system in accordance with a preferred embodiment of the invention.

Referring now to FIG. 1 there is shown a preferred embodiment of a personal emergency response system (PERS) 10 in accordance with the invention. The PERS comprises one or more subscriber alarm units 12, a plurality of slave units 14, a subscriber base station 16 and a central monitoring station 18.

Preferably each alarm unit 12 is a portable unit which is designed to be carried by the subscriber. Preferably, the portable alarm unit 12, is wirelessly coupled to each of the slave units 14 and to the subscriber base station 16. The portable alarm unit 12 includes an input device that can be actuated by the subscriber in the event of an emergency for generating an alarm signal to be received by one or more of the slave units 14 and/or the subscriber base station 16. Preferably the input device is an electrical switch but could be another type of device such as one which is voice actuated. Also, other types of alarm units 12, such as window and door detectors, smoke and carbon monoxide detectors, and motion detectors may also communicate with the slave unit 14 and/or the subscriber base station 16. While it is preferred that the alarm units 12 are wirelessly connected to the slave units 14 and/or subscriber base station 16, any one or all of the alarm units 14 may be connected by wires to any one or all of the slave stations 14 and/or base station 16.

The slave units 14 are designed to be located in multiple places throughout a living space, particularly in places where there is typically no access by the subscriber to a telephone, such as a bathroom, so that no matter where the subscriber may be within the living space, an alarm may be received by at least one slave station 14 and/or subscriber base station 16 from the alarm unit 12 and voice communication may be provided between the central monitoring station 18 with the subscriber. Preferably, each slave unit 14 includes the capability of receiving both wireless and wired alarm signals from an alarm unit 12 upon which, the slave unit 14 transmits an alert to the subscriber base station 16. Each slave 14 also includes a switch for initiating an alert. Preferably, each slave unit 14 also includes a speaker phone 20 to provide two-way voice communications between the central monitoring station 18 and the subscriber. Each slave unit 14 further provides the capability of sending and receiving voice and data signals between: (1) itself and other slave units 14 and (2) between itself and the subscriber base station 16. Preferably, the connections between the separate slave units 14, and between each slave unit 14 and the subscriber base station 16 are wireless. However, some or all of the connections between the slave units 14 and the subscriber base unit 16 could be wired.

Preferably, each slave unit 14 operates similarly to a cordless phone handset/base station such that each slave unit 14 can communicate with up to two other slave units and to the subscriber base station 16 using the well known cordless telephone CT2 standard. Thus, each slave 14 comprises functions of a cordless handset having at least three different security codes, and the functions of a cordless base station that can recognize at least three different security codes.

Preferably the subscriber base station 16 includes means for receiving the alert signal from each of the slave stations 14 and transmitting a signal corresponding to the alert signal, including identification information about the subscriber, to the central monitoring station 18. Preferably, communication with the central monitoring station 18 is via a commercial telephone communication link but could be by other means such as the Internet, a cable or a satellite communications link. The subscriber base station 16 also includes the capability for receiving and transmitting audio signals to each of the slave units 14 and to the central monitoring station 18. Preferably, the base subscriber station 16 is similar to the home base system 10 described in U.S. Pat. No. 6,445,298, the contents of which are hereby incorporated by reference in their entirety, but with the addition of a full duplex radio frequency transmission and reception (transceiver) capability for communicating with the multiple slave units 14. The implementation of such a transceiver is well known, as for example, the transceiver based on the CT2 standard as utilized by the base station of a cordless telephone. Such transceiver may be integral with the base station 16, or may be a separate unit which interfaces to the home base system 10 described in U.S. Pat. No. 6,445,298 (or its equivalent) by either a wireless or wired communications link.

In the preferred embodiment, when a slave unit 14, receives an alarm signal from one of the alarm units 12, the slave unit 14 establishes a connection with the subscriber base station 16 and generates an alert signal to be received by the subscriber base station 16. When the subscriber base station 16 receives the alert signal, the base station 16 issues an acknowledgement to the slave station 14, establishes a connection with the central monitoring station 18 and transmits a signal corresponding to the alert signal to the central monitoring station 18. At this point in time, a full duplex audio communication link is provided between the slave unit 14 that initiated the alert and the central monitoring station 18 via the subscriber base station 16. Consequently, an operator at the central monitoring station 18 may communicate directly with the subscriber by voice, determine the severity of the subscriber's condition and initiate an appropriate response.

It is possible that when an alarm signal is generated by an alarm unit 12 that is wirelessly connected to the slaves 14, more than one slave station 14 may receive an alarm signal that exceeds a predetermined threshold. Preferably each alarmed slave 14 will generate an alert for reception by the subscriber base station 16. The PERS system 10 then opens a full duplex voice connection between the central monitoring station 18 and each slave 14 that generated an alert. Alternatively, the signal strength of the alarm signal may be determined in each slave 14 and the signal strength transmitted with the alert to the subscriber base station 16 from each of the alarmed slaves 14. Advantageously, the location of the subscriber can be more precisely determined based on the largest signal strength and a single connection opened between the central monitoring station 18 and the slave 14 with the greatest signal strength.

It is also possible that only one slave 14 is alarmed, but for some reason, the alarmed slave 14 is unable to communicate with the subscriber base station 16, i.e. the alarmed slave 14 fails to receive an acknowledgement that a connection has been made with the subscriber base station 16. In that case, because each slave 14 can also operate as a base station, the alarmed slave 14 adopts a different security code and establishes a voice/data connection with another slave station 14. The other slave station then acts as a repeater for providing voice and data communications between the alarmed slave 14 and the subscriber base station 16.

As disclosed, the present invention is an improvement over existing PERS by providing multiple slave units, thus providing: (1) the capability of voice communications between a subscriber and a central monitoring station regardless of where the subscriber is in the living space and (2) multiple communication paths from a subscriber to the subscriber base station, increasing the reliability of the system and thus increasing the likelihood that an injured person may receive appropriate assistance. The system further reduces false alarms due to non-emergencies by providing more reliable voice connections and provides greater visibility into the severity of an emergency event, thereby leading to more efficient use of EMS personnel.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A monitoring system comprising:

a base station;

a plurality of interconnected slave units, wherein each one of the slave units is adapted to:

(a) receiving an alarm from an alarm unit; and (b) transmitting an alert corresponding to the alarm to the base station; and a central monitoring station operatively connected with the base station, said monitoring system being adapted to providing a full duplex voice channel between the central monitoring station and each slave unit.

2. The monitoring system of claim 1, wherein instead of providing the full duplex voice channel between the central monitoring station and each slave unit, the full duplex voice channel is provided to only each slave unit from which an alert was received by the base station.

3. The monitoring system of claim 2, wherein each alarmed slave unit transmits a strength of the alarm signal to the base station.

4. The monitoring system of claim 1, wherein each alarmed slave unit is adapted to transmitting a strength of the alarm signal to the base station.

5. A monitoring system comprising:

a base station; and a plurality of interconnected slave units, wherein each one of the slave units is adapted to:

(a) receiving an alarm from an alarm unit; and (b) transmitting an alert corresponding to the alarm to the base station;

wherein said base station is adapted to providing an acknowledgement of the alert to each alarmed slave unit, and if the acknowledgement is not received by the alarmed slave unit, the alarmed slave unit is adapted to transmitting the alert to another one of the slave units, wherein the another slave unit is adapted to transmitting the alert to the base station.

6. A monitoring system comprising:

a base station;

a plurality of interconnected slave units, wherein each one of the slave units is adapted to:

(a) receiving an alarm from an alarm unit; and (b) transmitting an alert corresponding to the alarm to the base station;

wherein each alarmed slave unit is adapted to transmitting a strength of the alarm signal to the base station; and a central monitoring station, wherein the base station is adapted to transmitting a signal to the central monitoring station identifying the alarmed slave unit from which the largest signal strength was received, and wherein the monitoring system is adapted to providing a full duplex voice channel between the central monitoring station and the alarmed slave unit from which the highest signal strength was received.

7. A monitoring system comprising:

a base station;

a plurality of interconnected slave units, wherein each one of the slave units is adapted to:

(a) receiving an alarm from an alarm unit; and (b) transmitting an alert corresponding to the alarm to the base station;

wherein each alarmed slave unit is adapted to transmitting a strength of the alarm signal to the base station; and a central monitoring station, wherein the base station is adapted to transmitting a signal to the central monitoring station identifying each alarmed slave unit from which the alert was received and the strength of the corresponding alarm, and wherein the monitoring system is adapted to providing a full duplex voice channel between the central monitoring station and the alarmed slave unit from which the highest signal strength was received.

8. A method for providing voice communication between a subscriber and a central monitoring station comprising the steps of:

receiving an alarm from an alarm unit actuated by the subscriber in at least one of a plurality of interconnected slave units; and transmitting from each alarmed slave unit to a base station, an alert corresponding to the alarm, and thereafter providing a full duplex voice channel between each slave unit and the central monitoring station.

9. The method of claim 8, wherein instead of providing the full duplex voice channel between the central monitoring station and each slave unit, the full duplex voice channel is provided to each alarmed slave unit from which an alert was received by the base station.

10. The method of claim 8, further including the step of each one of the alarmed slave units transmitting a strength of the alarm signal to the base station.

11. A method for providing voice communication between a subscriber and a central monitoring station comprising the steps of:

receiving an alarm from an alarm unit actuated by the subscriber in at least one slave unit; and transmitting from each alarmed slave unit to a base station, an alert corresponding to the alarm, and thereafter providing a full duplex voice channel between each slave unit and the central monitoring station, further including the step of transmitting an acknowledgement of the alert from the base station to each alarmed slave unit, and if the acknowledgement is not received by one of the alarmed slave units, the alert is transmitted by the one alarmed slave unit to another slave unit, wherein the another slave unit transmits the alert to the base station.

12. A method for providing voice communication between a subscriber and a central monitoring station comprising the steps of:

receiving an alarm from an alarm unit actuated by the subscriber in at least one slave unit; and transmitting from each alarmed slave unit to a base station, an alert corresponding to the alarm, and thereafter providing a full duplex voice channel between each slave unit and the central monitoring station, further including the step of each one of the alarmed slave units transmitting a strength of the alarm signal to the base station and, further including the step of the base station transmitting a signal to the central monitoring station identifying the alarmed slave unit from which the largest signal strength was received, and instead of providing the full duplex voice channel between each slave unit and the central monitoring station, providing the full duplex voice channel between the central monitoring station and the alarmed slave unit from which the highest signal strength was received.

13. A method for providing voice communication between a subscriber and a central monitoring station comprising the steps of:

receiving an alarm from an alarm unit actuated by the subscriber in at least one slave unit; and transmitting from each alarmed slave unit to a base station, an alert corresponding to the alarm, and thereafter providing a full duplex voice channel between each slave unit and the central monitoring station, further including the step of each one of the alarmed slave units transmitting a strength of the alarm signal to the base station and The method of claim 11, further including the step of the base station transmitting a signal to the central monitoring station identifying each one of the alarmed slave units from which the alert was received and the strength of the corresponding alarm, and instead of providing the full duplex voice channel between each slave unit and the central monitoring station, providing the full duplex voice channel between the central monitoring station and the alarmed slave unit from which the highest signal strength was received.

* * * * *